US011174143B1

(12) United States Patent
Huang

(10) Patent No.: US 11,174,143 B1
(45) Date of Patent: Nov. 16, 2021

(54) AUTOMATIC COSMETIC BOTTLE CAPPING DEVICE BY MEANS OF PNEUMATIC ABSORPTION

(71) Applicants: LOOBI (GUANGZHOU) HEALTH INDUSTRY CO., LTD, Guangdong (CN); GUANGZHOU HWASUEN HEALTH INDUSTRY CO., LTD, Guangdong (CN)

(72) Inventor: Minjia Huang, Guangdong (CN)

(73) Assignees: LOOBI (GUANGZHOU) HEALTH INDUSTRY CO., LTD, Guangdong (CN); GUANGZHOU HWASUEN HEALTH INDUSTRY CO., LTD, Guangdong (CN)

( * ) Notice: Subject to any disclaimer, the term of this patent is extended or adjusted under 35 U.S.C. 154(b) by 0 days.

(21) Appl. No.: 17/376,298

(22) Filed: Jul. 15, 2021

(30) Foreign Application Priority Data

Jul. 30, 2020 (CN) ..... 202010753574.1

(51) Int. Cl.
*B67B 3/28* (2006.01)
*B65B 7/28* (2006.01)
(Continued)

(52) U.S. Cl.
CPC ..... *B67B 3/22* (2013.01); *B65B 7/2807* (2013.01); *B65B 7/2821* (2013.01); *B67B 1/005* (2013.01);
(Continued)

(58) Field of Classification Search
CPC .. B67B 1/00; B67B 1/005; B67B 1/04; B67B 3/00; B67B 3/22; B67B 3/26; B67B 3/28
(Continued)

(56) References Cited

U.S. PATENT DOCUMENTS 2,143,806 A * 1/1939 Stuart ..... B67B 3/22 53/302
2,840,970 A * 7/1958 Brown ..... B67B 1/005 53/328
(Continued)

FOREIGN PATENT DOCUMENTS

CN 201374344 Y 12/2009
CN 207726332 U 8/2018
(Continued)

OTHER PUBLICATIONS

CN Search report dated Jul. 30, 2020 in Chinese application (No. 2020107535741).
(Continued)

*Primary Examiner* — Stephen F. Gerrity
(74) *Attorney, Agent, or Firm* — McClure, Qualey & Rodack, LLP

(57) ABSTRACT

An automatic cosmetic bottle capping having a first conveyor belt, a second conveyor belt, and a third conveyor belt. A sliding convex is provided at a surface of the first conveyor belt, a capper is movably sleeved on the first conveyor belt, a suction tip is provided in the capper, rolling balls are provided inside the capper, a through-hole is provided in an external surface of the capper, a capping claw is provided on a lower end of the capper, a positioning plate is provided on an upper end of the capper, springs are provided at a lower end of the positioning plate, a hole plug is movably connected outside the through-hole, and a cap is provided on a front end of the second conveyor belt.

4 Claims, 8 Drawing Sheets

(51) Int. Cl.

| | |
|---|---|
| ***B67B 1/00*** | (2006.01) |
| ***B67B 1/04*** | (2006.01) |
| ***B67B 3/22*** | (2006.01) |
| ***B67B 3/26*** | (2006.01) |

(52) U.S. Cl.
CPC ..... *B67B 1/04* (2013.01); *B67B 3/26* (2013.01); *B67B 3/28* (2013.01)

(58) Field of Classification Search
USPC ..... 53/306, 310, 312, 319, 324, 328
See application file for complete search history.

(56) References Cited

U.S. PATENT DOCUMENTS

| | | | | |
|---|---|---|---|---|
| 3,392,505 | A | 7/1968 | Luther | |
| 4,186,542 | A * | 2/1980 | Oyagi | B67B 1/04 53/109 |
| 2001/0032438 | A1 * | 10/2001 | Bonotto | B65B 7/2807 53/307 |
| 2019/0134827 | A1 | 5/2019 | Wagner et al. | |

FOREIGN PATENT DOCUMENTS

| | | | |
|---|---|---|---|
| CN | 207760004 | U | 8/2018 |
| CN | 108706335 | A | 10/2018 |
| CN | 109648507 | A | 4/2019 |
| CN | 110435949 | A | 11/2019 |
| CN | 209758993 | U | 12/2019 |
| GB | 600074 | A | 3/1948 |
| JP | 2005138892 | A | 6/2005 |

OTHER PUBLICATIONS

English translation of CN Search report dated Jul. 30, 2020 in Chinese application (No. 202010753574.1).
CN Office Action dated Oct. 28, 2020 in Chinese application (No. 202010753574.1).
English translation of CN Office Action dated Oct. 28, 2020 in Chinese application (No. 202010753574.1).
Chinese language amendment/response filed in response to Office action dated Oct. 28, 2020 in Chinese application (No. 202010753574.1).
English translation of amendment/response filed in response to Office action dated Oct. 28, 2020 in Chinese application (No. 202010753574.1).
Chinese language voluntary amendment dated Nov. 2, 2020 in Chinese application (No. 202010753574.1).
English translation of voluntary amendment dated Nov. 2, 2020 in Chinese application (No. 202010753574.1).
Notice of Allowance dated Nov. 25, 2020 in Chinese application (No. 202010753574.1).
English translation of Notice of Allowance dated Nov. 25, 2020 in Chinese application (No. 202010753574.1).

* cited by examiner

AUTOMATIC COSMETIC BOTTLE CAPPING DEVICE BY MEANS OF PNEUMATIC ABSORPTION

TECHNICAL FIELD

The present invention relates to cosmetics field, specifically an automatic cosmetic bottle capping device by means of pneumatic absorption.

BACKGROUND TECHNOLOGY

According to Administrative Provisions on Cosmetic Labeling published on Aug. 272007 by the General Administration of Quality Supervision, Inspection and Quarantine of the People's Republic of China, cosmetic refers to chemical and industrial articles or fine chemical and industrial products intended to be applied to any part of the human body, such as skin, hair, nails of fingers or toes, lips and teeth, etc. by spraying, spilling or any other similar ways for cleansing, beautifying, promoting attractiveness, altering the appearance, changing the smell of the human body, or maintaining sound conditions of the human body.

Whether strict control is executed during cosmetic production or not is one of critical factors influencing whether the finished cosmetic products are of good quality, and mounting precision of cosmetic bottle caps will directly affect to what degree sealing of the finished products is done, in case sealing is not tight enough, the cosmetic may directly contact foreign matters, which will result in deterioration and rot of the cosmetic, and overall quality degradation. Manual cap loading involves high cost, and common automatic equipment mounts caps by a mechanical claw, which is structurally complicated and cap loading precision is low.

SUMMARY OF THE INVENTION

Technical Problems to Solve

Targeting at deficiencies of the prior art, the present invention proposes a automatic cosmetic bottle capping device by means of pneumatic absorption, which is characterized in having advantages such as being labor saving, structurally simple and of high capping precision, and addresses the problems such as high labor cost, being structurally complicated and low cap loading precision.

Technical Solution

To realize purposes of labor saving, simple structure and high capping precision, the present invention provides a following technical solution: an automatic cosmetic bottle capping device by means of pneumatic absorption, comprising a first conveyor belt, a second conveyor belt and a third conveyor belt; a sliding convex is provided on a surface of an inner round of the first conveyor belt, a capper is movably sleeved on the first conveyor belt, a suction tip is provided in a central portion of the capper, rolling balls are fixedly provided inside the capper, a through-hole is provided in an outer surface of the capper, a capping claw is provided on a lower end portion of the capper, a positioning plate is provided on an upper end portion of the capper, springs are provided at a lower end of the positioning plate, a hole plug is movably provided outside the through-hole, a cap is provided at a front end portion of the second conveyor belt, a cosmetic bottle is provided at a front end portion of the third conveyor belt, and a finished product is provided at a rear end portion of the third conveyor belt.

Preferably, an upper end portion of the suction tip reaches outside the upper end portion of the capper, and an air exhauster or similar equipment is provided for extracting air from the suction tip and reducing air pressure inside the suction tip.

Preferably, the hole plug is a three-quarter circle, when looking down, the hole plug starts from a corner of the second conveyor belt clockwise until a corner of the third conveyor belt.

Preferably, a width of the sliding convex matches a width of a gap of the rolling balls, and the sliding convex engages with the rolling balls precisely.

Preferably, a thickness of the hole plug matches a diameter of the through-hole and the hole plug contacts the through-hole closely when the hole plug comes into contact with the capper.

Preferably, a short downward concave is provided in the sliding convex at a position perpendicular to an end portion together with the hole plug.

Preferably, an opening is provided in the capping claw and the opening is connected with a lower end portion of the suction tip.

Preferably, the first conveyor belt rotates counter-clockwise when looking down, and the second conveyor belt and the third conveyor belt convey from a lower left portion to an upper right portion and (an) external motor(s) provided power for all three conveyor belts.

Beneficial Effects

Compared with the prior art, the automatic cosmetic bottle capping device by means of pneumatic absorption provided in the present invention has following beneficial effects:

1. The automatic cosmetic bottle capping device by means of pneumatic absorption has realized automatic capping of cosmetic bottles by coordination of the first conveyor belt, the second conveyor belt and the third conveyor belt, and can free manpower, save materials and save product cost from a mechanical aspect.
2. In the automatic cosmetic bottle capping device by means of pneumatic absorption, by cooperation of the suction tip, the rolling balls, the through-hole, the positioning plate, the springs and the hole plug, common design of mechanical claws or mechanical clips are lifted, so that effects such as a stable and simple structure and high capping precision are achieved, and manufacturing and maintenance costs have been reduced, which in turn reduces price of the finished product and improves profit.

Figure 1:
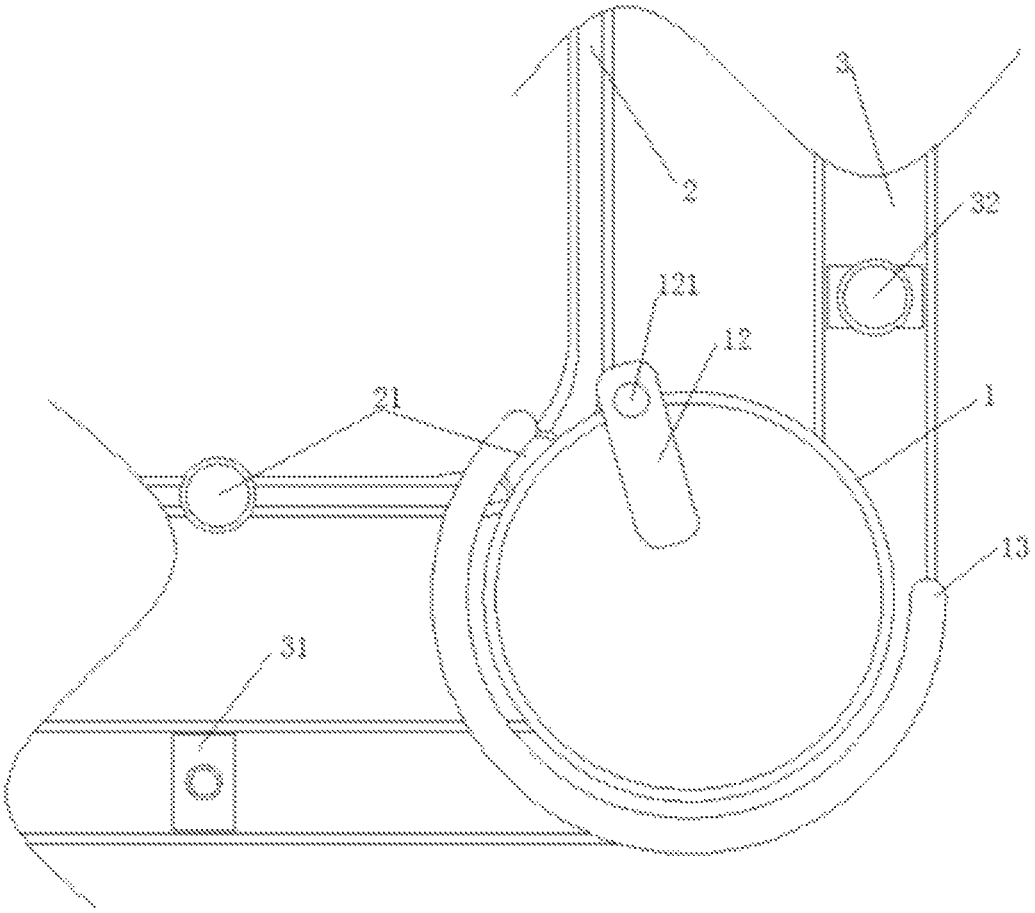
FIG. 1 is a structural top view of the present invention.

In the drawings: 1, first conveyor belt; 11, sliding convex; 12, capper; 121, suction tip; 122, rolling ball; 123, through-hole; 124, capping claw; 125, positioning plate; 126. Spring; 13, hole plug; 2, second conveyor belt; 21, cap; 3, third conveyor belt; 31, cosmetic bottle; 32, finished product.

EMBODIMENTS

Hereinafter, a clear and complete description will be given to the technical solutions in embodiments of the present invention in combination with accompanying drawings of the embodiments of the present invention; apparently, the embodiments described herein are only some of embodiments of the present invention, rather than all. Based on the embodiments provided herein, all other embodiments made by those of ordinary skill in the art without making creative effort fall into protection scope of the present invention.

Referring to FIG. 1 to FIG. 8, an automatic cosmetic bottle capping device by means of pneumatic absorption, comprising a first conveyor belt 1, a second conveyor belt 2, and a third conveyor belt 3; wherein when looking down the first conveyor belt 1 rotates counter-clockwise, the second conveyor belt 2 and the third conveyor belt 3 convey from a lower left corner to an upper right corner, and all the conveyor belts are supplied by (an) external motor(s) or other similar equipment.

A sliding convex 11 is provided on a surface of an inner round of the first conveyor belt 1, and a short downward concave is provided in the sliding convex 11 parallel to the hole plug. The short downward concave can have the rolling balls 122 drive the capper 12 to press downward, so as to press a cap 21 to a cosmetic bottle 31.

A capper 12 is movably sleeved in the first conveyor belt 1, a suction tip 121 is provided at a central portion of the capper 12, an upper end of the suction tip 121 reaches out of an upper end portion of the capper 12, and an air exhauster or similar equipment is provided for drawing air from the upper end of the suction tip 121 to reduce air pressure in the suction tip 121. The air pressure in the suction tip 121 is thus reduced.

Rolling balls 122 are fixedly provided in the capper 12, and a width of the sliding convex 11 matches a width of a gap of the rolling balls 122, and the sliding convex 11 engages with the rolling balls. The rolling balls 122 drive the entire capper 12 along a track of the sliding convex 11.

A through-hole 123 is provided on an outer surface of the capper 12, a thickness of a hole plug 13 matches a diameter of the through-hole, so that the hole plug 13 contacts the through-hole 123 tightly all the time when the capper 12 contacts the hole plug 13. And when the capper 12 moves along the first conveyor belt 1 and contacts the hole plug 13, the hole plug 13 will block air communication at the through-hole 123.

A capping claw 124 is fixedly provided at a lower end of the capper 12, an opening is provided in a central portion of the capping claw 124 and the opening is connected with a lower end of the suction tip 121. When the capping claw 124 passes an upper end of the cap 21, as internal air pressure in the suction tip 121 is small, the capping claw 124 will grasp the cap 21.

A positioning plate 125 is fixedly provided at an upper end of the capper 12, and springs 126 are fixedly provided at a lower end of the positioning plate 125; the hole plug 13 is movably connected outside the through-hole 123, and the hole plug 13 when looking down upon is a three-quarter circle, starting from a corner of the second conveyor belt 2 and ending at a corner of the third conveyor belt 3. When the hole plug 13 contacts the capper 12, the through-hole 123 is blocked, so reduced air pressure in the suction tip 121 can only be balanced at the capping claw 124, so the cap 21 is picked up at the corner of the second conveyor belt 2 and is released at the corner of the third conveyor belt 3.

The cap 21 is provided at a front end of the second conveyor belt 2, the cosmetic bottle 31 is provided at a front end of the third conveyor belt 3, and the finished product 32 is provided at a rear end of the third conveyor belt 3. The cap 21 moves along with the second conveyor belt 2 from a left side upwards and the cosmetic bottle 31 moves upwards along with the third conveyor belt 3 from the left side and are assembled to be the finished product 32.

Working principles: referring to FIG. 1, the cap 21 and the cosmetic bottle 31 are conveyed respectively by the second conveyor belt 2 and the third conveyor belt 3 from the lower left portion to the upper right portion and assembled by the capper 12 to be the finished product 32, which is conveyed outside by the third conveyor belt 3.

Figure 2:
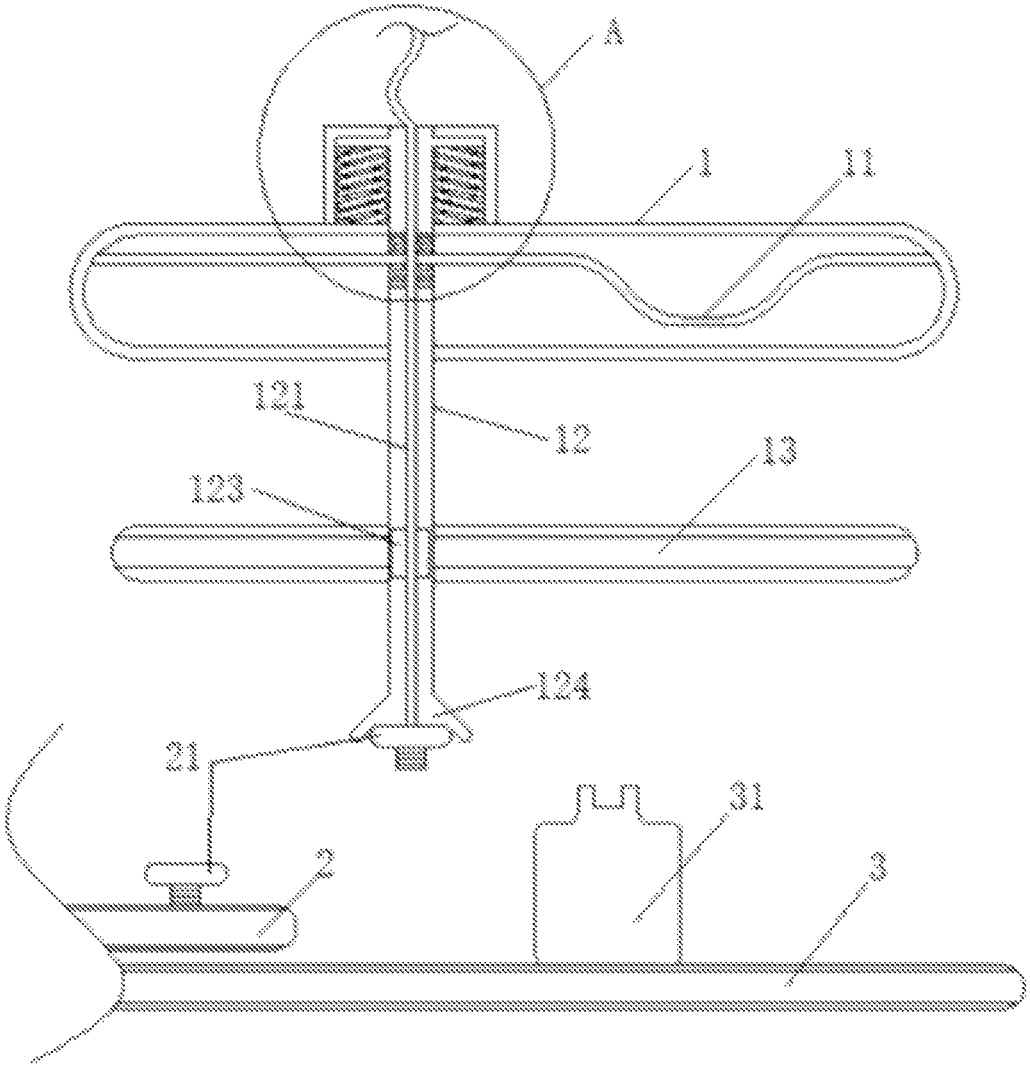
FIG. 2 is a structural diagram of a front section of the present invention.
Figure 3:
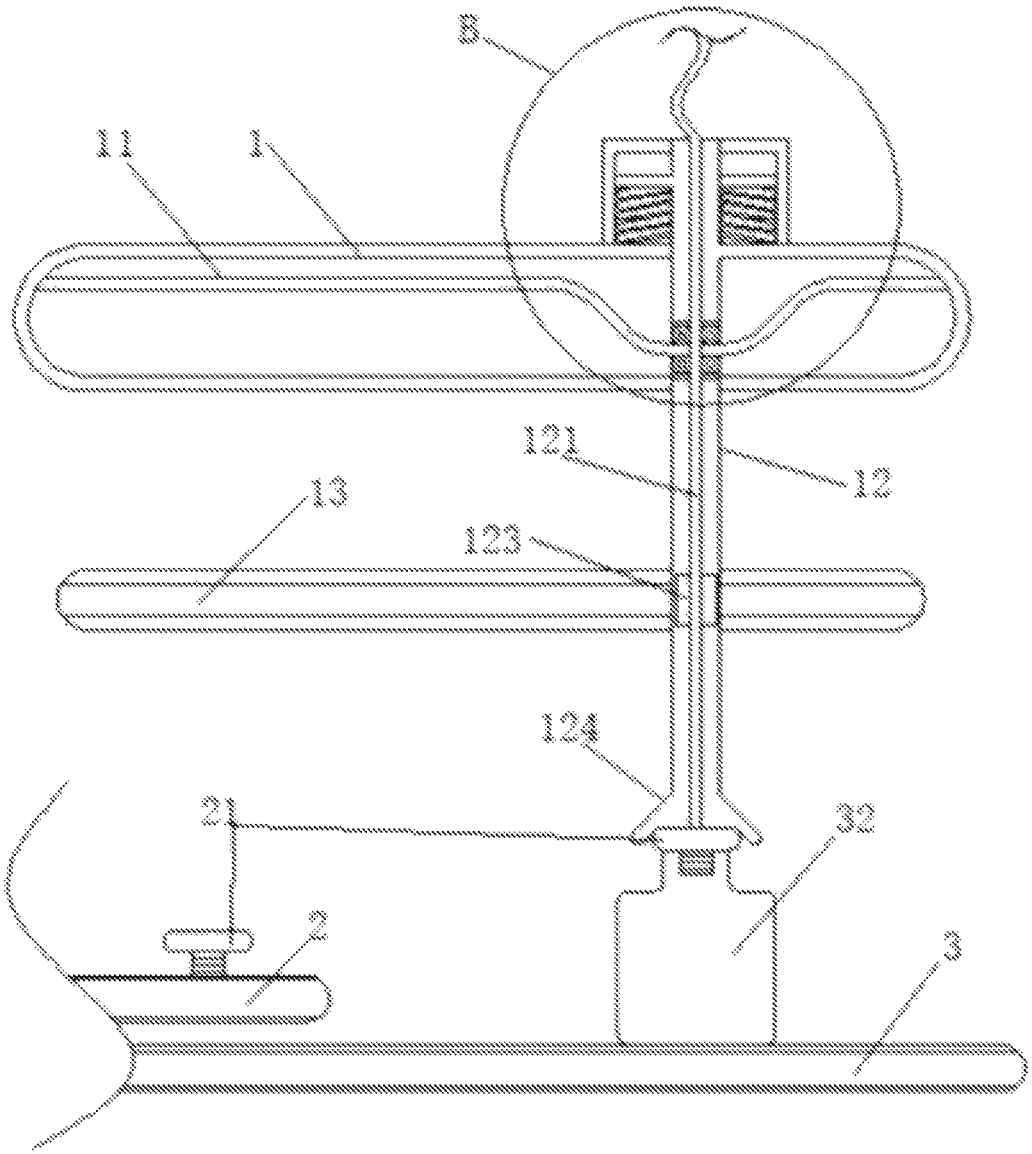
FIG. 3 is a structural diagram of the front section and capping activities of the present invention.
Figure 4:
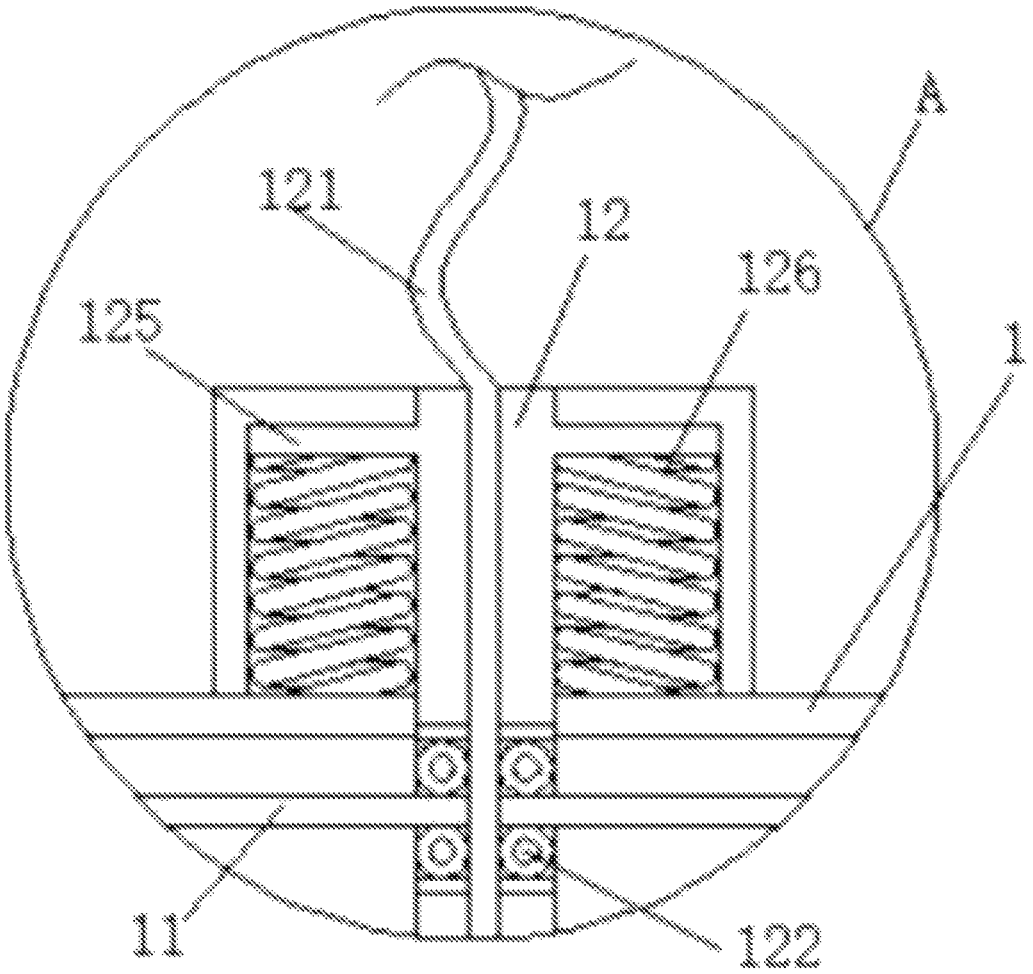
FIG. 4 is an enlarged structural diagram of a part A in FIG. 2 of the present invention.
Figure 5:
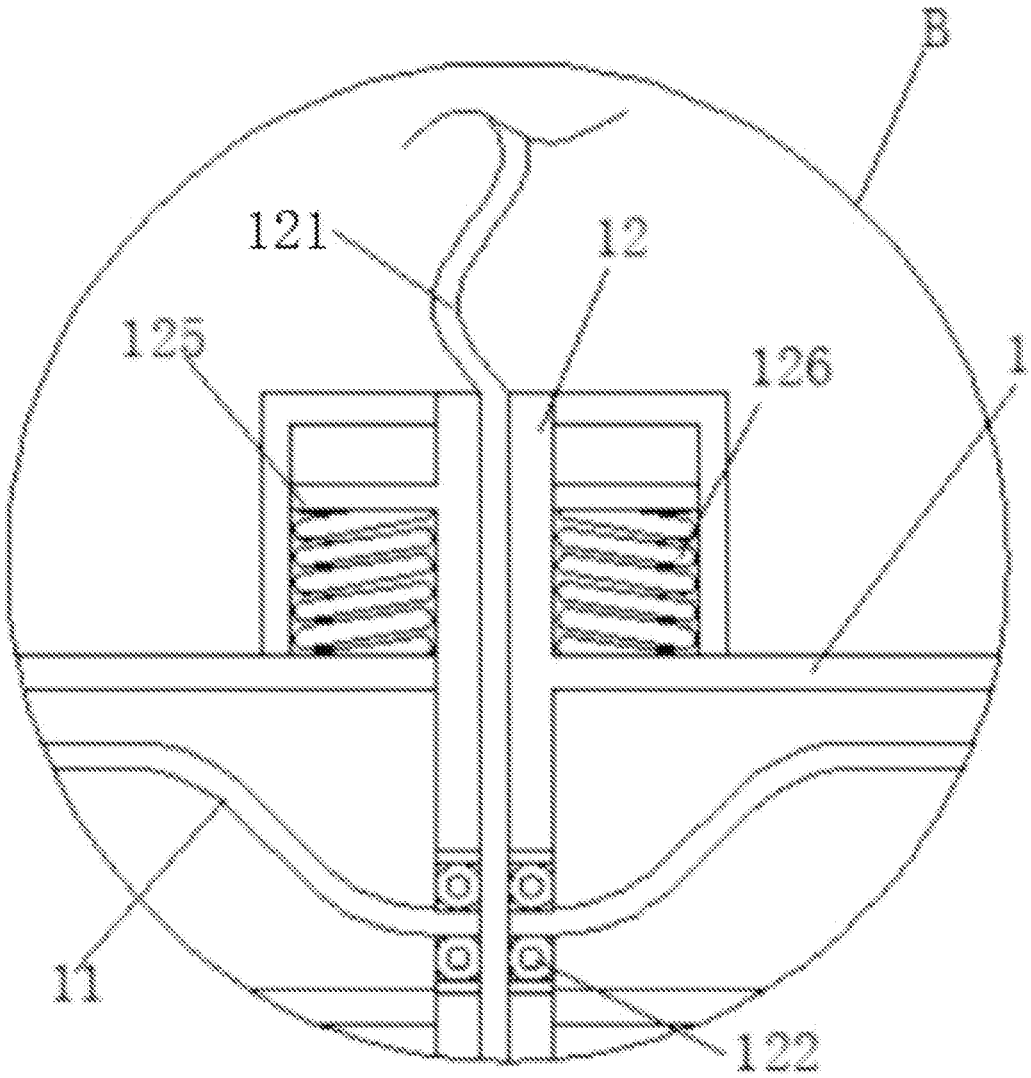
FIG. 5 is an enlarged structural diagram of a part B in FIG. 3 of the present invention.
Figure 7:
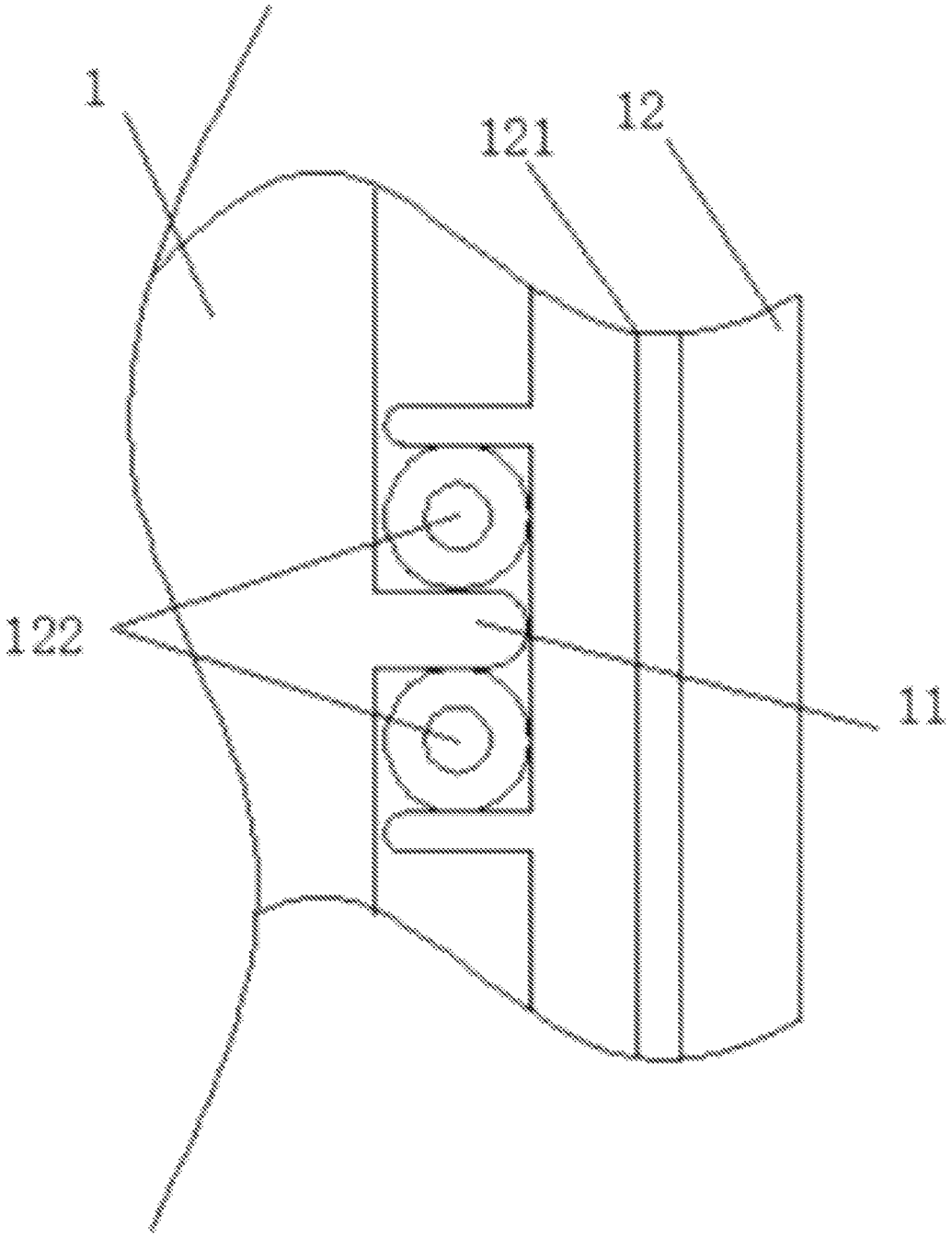
FIG. 7 is a structural diagram showing a side section of the rolling balls of the present invention.

Referring to FIG. 2, FIG. 4 and FIG. 7, the rolling balls 122, vertically fixed by the sliding convex 11, guides the entire capper 12 to convey reciprocally along counter-clockwise rotation of the first conveyor belt 1 when looking down upon. With respect to FIG. 2, FIG. 3, FIG. 4 and FIG. 5, the rolling balls 122 guide the entire capper 12 to move downwards when coming to the short downward concave in the sliding convex 11, the positioning plate 125 gives a downward force on the springs 126, which is in turn compressed.

Figure 6:
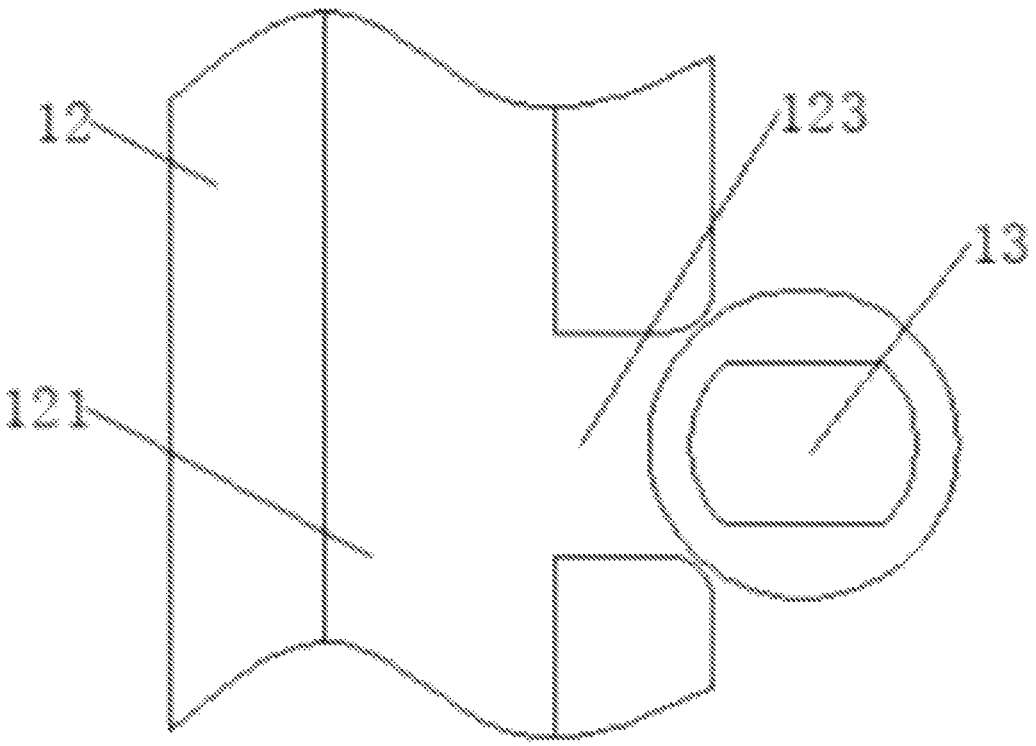
FIG. 6 is a structural diagram showing a side section of the through-hole and the hole plug of the present invention.
Figure 8:
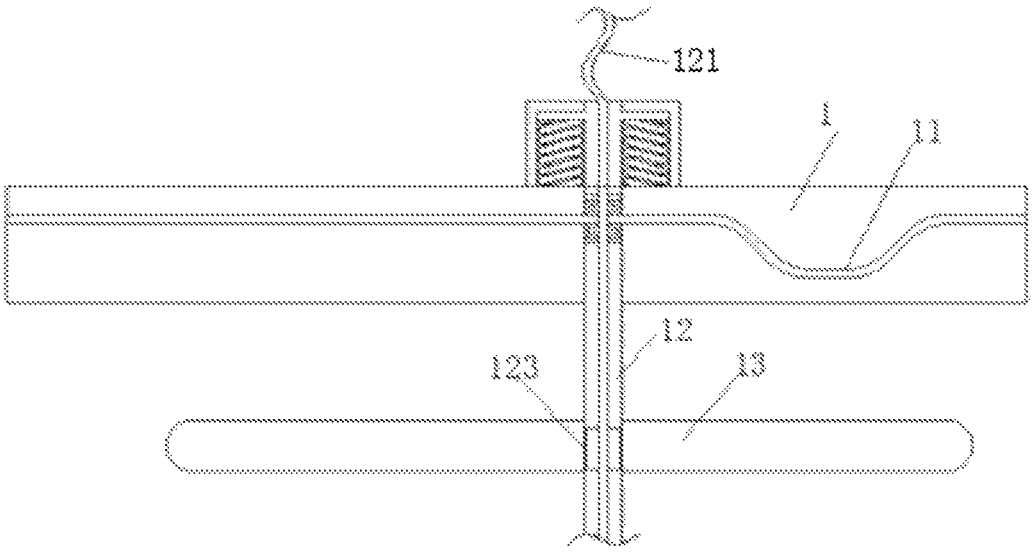
FIG. 8 is a diagram showing in an extended form synchronization and positions of the first conveyor belt and the hole plug of the present invention.

See FIG. 6 and FIG. 8, wherein air pressure in the upper part of the suction tip 121 is reduced by external equipment, and internal air pressure of the suction tip 121 is low, so the suction tip 121 balances internal air pressure with the opening at the capping claw 124 and the through-hole 123, and absorption abilities of the capping claw is weak; and when the through-hole 123 is blocked by the hole plug 13, the suction tip 121 can only balance air pressure with the capping claw 124, so absorption abilities of the capping claw 124 is improved.

Combining FIG. 1, FIG. 2, FIG. 3 and the foregoing structural analysis: the cap 21 is conveyed by the second conveyor belt 2 to the corner, and the capper 12 on the first conveyor belt 1 runs to a position of the hole plug 13, where the through-hole 123 is blocked, and absorption abilities of the capping claw 124 increase, the cap 21 is drawn into the capping claw 124, and moved by the capper 12 to the corner of the third conveyor belt 3. The capper 12 is pressed downward due to the short downward concave in the sliding convex 11, and guides the cap to cover the cosmetic bottle 31 conveyed by the third conveyor belt 3. And when the first conveyor belt 1 continues moving, the capper 12 no longer contacts the hole plug 13, the through-hole 123 is free from blockage, so absorption abilities of the capping claw 124 are reduced, the cap 21 is released, the finished product 32 is conveyed out on an upper side of the third conveyor belt 3. A capping action is thereby completed.

Above all, the automatic cosmetic bottle capping device by means of pneumatic absorption has realized automatic cosmetic bottle capping by coordination of the first conveyor belt 1, the second conveyor belt 2, the third conveyor belt 3, the capper 12 and the capping claw 124, effects of labor and material saving have been achieved and cost of the finished product 32 is saved from a mechanical aspect. And by cooperation of the suction tip 121, the rolling balls 122, the through-hole 123, the positioning plate 125, the springs 126 and the hole plug 13, effects of a simple structure and high capping precision have been achieved, and manufacturing and maintenance cost has been reduced too, which in turn reduces price of the finished product 32 and raises profits of the finished product 32.

Although embodiments of the present invention have been shown and described, many variations, modifications, equivalent replacement and alternations are still possible for those of ordinary skill in the art without departing from principles and spirits of the present invention, and protection scope of the present invention is defined by the appended claims and equivalents thereof.

The invention claimed is:

1. An automatic cosmetic bottle capping device by means of pneumatic absorption, comprising a first conveyor belt (1), a second conveyor belt (2) and a third conveyor belt (3), wherein a sliding convex (11) is provided at a surface of an inner round of the first conveyor belt (1), a capper (12) is movably sleeved on a conveyor belt of the first conveyor belt (1), a suction tip (121) is provided in a central portion of the capper (12), rolling balls (122) are fixedly connected in the capper (12), a through-hole (123) is provided in an outer surface of the capper (12), a capping claw (124) is fixedly connected to a lower end of the capper (12), a positioning plate (125) is fixedly provided on an upper end of the capper (12), springs (126) are provided to a lower end of the positioning plate (125), a hole plug (13) is provided movably outside the through-hole (123), a cap (21) is placed on a front end of the second conveyor belt (2), a cosmetic bottle (31) is placed on a front end of the third conveyor belt (3), and a finished product (32) is provided on a rear end of the third conveyor belt; when looking down upon, the hole plug (13) is a three-quarter circle, and starts from a corner of the second conveyor belt (2) to a corner of the third conveyor belt (3); when viewing from a higher position, the first conveyor belt (1) rotates counter-clockwise, both the second conveyor belt (2) and the third conveyor belt (3) rotate from a lower left part to an upper right part, and all conveyor belts are energized by at least one external motor; a thickness of the hole plug (13) matches a diameter of the through-hole (123), and the hole plug (13) contacts tightly the through-hole (123) when coming into contact with the capper (12); the cap (21) and the cosmetic bottle (31) are conveyed respectively by the second conveyor belt (2) and the third conveyor belt (3) from the lower left part to the upper right part, assembled by the capper (12) to be the finished product (32) and conveyed outside from an upper end of the third conveyor belt (3); and when the capper (12) moves along with the first conveyor belt (1) to a position contacting the hole plug (13), the hole plug (13) will block air communication at the through-hole (123), the cap (21) is drawn at the corner of the second conveyor belt (2) and released at the corner of the third conveyor belt (3).

2. The automatic cosmetic bottle capping device by means of pneumatic absorption according to claim 1, wherein, an upper end of the suction tip (121) extends out of an upper end of the capper (12) and air inside the suction tip (121) is drawn by an air extractor to reduce air pressure inside the suction tip (121).

3. The automatic cosmetic bottle capping device by means of pneumatic absorption according to claim 1, wherein a width of the sliding convex (11) matches a width of a gap of the rolling balls (122) and the sliding convex (11) engages with the rolling balls (122) precisely.

4. The automatic cosmetic bottle capping device by means of pneumatic absorption according to claim 1, wherein an opening is provided in a center of the capping claw (124) and the opening is connected with a lower end of the suction tip (121).

* * * * *